US006559750B2

(12) United States Patent
Koyama et al.

(10) Patent No.: US 6,559,750 B2
(45) Date of Patent: May 6, 2003

(54) TRANSFORMER AND ELECTRICAL DEVICE USING THE SAME

(75) Inventors: Takanori Koyama, Kyoto-fu (JP); Tatsuya Hosotani, Muko (JP); Hiroshi Takemura, Muko (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 24 days.

(21) Appl. No.: 09/915,116

(22) Filed: Jul. 25, 2001

(65) Prior Publication Data

US 2002/0057175 A1 May 16, 2002

(30) Foreign Application Priority Data

Jul. 28, 2000 (JP) ..... 2000-229752

(51) Int. Cl.[7] ..... H01F 5/00
(52) U.S. Cl. ..... 336/200; 336/223; 336/232
(58) Field of Search ..... 336/83, 200, 223, 336/232

(56) References Cited

U.S. PATENT DOCUMENTS 5,631,822 A * 5/1997 Silberkleit et al. ..... 363/144
6,211,767 B1 * 4/2001 Jitaru ..... 336/200

FOREIGN PATENT DOCUMENTS

JP 05006829 * 1/1993 ..... 336/200

* cited by examiner

*Primary Examiner*—Anh Mai
(74) *Attorney, Agent, or Firm*—Keating & Bennett, LLP

(57) ABSTRACT

A transformer comprises first and second flat coils stacked with each other. Each of first and second flat coils comprises a conductive wire which is wound in a flat spiral shape having a through hole at a center thereof such that the conductive wire has an inner end and an outer end at an inner periphery and an outer periphery of the spiral shape, respectively. The inner end of the first flat coil passes through the through hole of the second flat coil, thus reducing the overall thickness of the transformer because both inner ends pass over only one flat coil.

20 Claims, 8 Drawing Sheets

TRANSFORMER AND ELECTRICAL DEVICE USING THE SAME

BACKGROUND OF THE INVENTION

1. Field of the Invention

The present invention relates to transformers and electrical devices using the same. In particular, the present invention relates to a transformer to be used for a switching power supply device and to an electrical device using the transformer.

2. Description of the Related Art

FIG. 10 is an exploded perspective view of a known thin transformer. In FIG. 10, a transformer 1 includes flat coils 2, 3, and 4 which are formed by winding wires in spirals and which coaxially overlap each other with doughnut-shaped insulative sheets 5 and 6 therebetween, and core members 7 and 8 sandwiching the flat coils 2, 3, and 4 and the insulative sheets 5 and 6. The flat coils 2, 3, and 4 coaxially overlapping each other are individually provided with holes for passing a magnetic core-leg formed in central parts of the flat coils 2, 3, and 4. The core members 7 and 8 are each provided with a magnetic core-leg.

FIG. 11A is a plan view of the flat coil 3 of the transformer 1. FIG. 11B is a sectional view along line A—A of the flat coil 3 shown in FIG. 11A. In FIG. 11A, the flat coil 3 is formed with a wire 3*a* wound in a spiral. An inner end 3*b* of the wire 3*a* is drawn to the outside over the other part of the wire 3*a*. An outer end 3*c* of the wire 3*c* is drawn to the outside in the same winding direction.

The thickness of the overall flat coil 3 thus formed is substantially the same as the diameter of the wire 3*a*. However, the thickness of the flat coil 3 is at least twice the diameter of the wire 3*a* in a portion of the flat coil 3 over which the inner end 3*b* of the wire 3*a* is drawn to the outside. The flat coils 2 and 4 each have the same configuration as the flat coil 3 shown in FIGS. 11A and 11B.

The transformer I shown in FIG. 10 includes the flat coils 2, 3, and 4 overlapping each other, each having the thickness twice the diameter of the wire 3*a*, whereby the thickness of the flat coils 2, 3, and 4 becomes six times the diameter of the wire 3*a*. Since the transformer 1 also includes the insulative sheets 5 and 6 each having a given thickness, there is a problem in that the thickness of the transformer 1 is increased.

SUMMARY OF THE INVENTION

Accordingly, it is an object of the present invention to provide a transformer which can be reduced in thickness and an electrical device using the transformer.

To the end, according to an aspect of the present invention, a transformer comprises a plurality of flat coils overlapping each other, each formed by winding a wire in a spiral. Respective inner ends of the wires forming at least two of the plurality of flat coils are drawn out through a hole for passing a magnetic core-leg and over one of the plurality of flat coils. The respective inner ends are disposed on the same surface of the one of the plurality of flat coils.

The inner ends of the other two of the plurality of flat coils may be connected to each other.

In the transformer according to the present invention, respective outer ends of the wires forming two of the plurality of flat coils may be connected to each other.

The wire forming at least one of the plurality of flat coils may be a three-layer insulated wire.

The wire may be a self-welding-type three-layer insulted wire.

An electrical device according to the present invention is provided which comprises the transformer described above.

The transformer according to the present invention can be reduced in thickness by arranging the same as described above.

The electrical device according to the present invention can be reduced in thickness and in size.

BRIEF DESCRIPTION OF THE DRAWING(S)

DETAILED DESCRIPTION OF EMBODIMENTS OF THE INVENTION

Figure 1A:
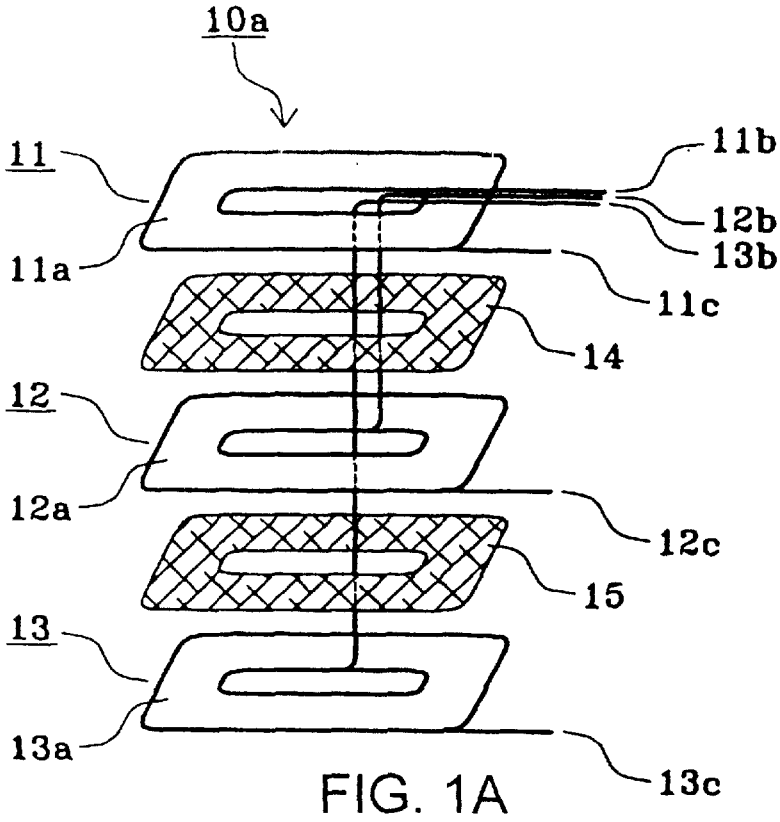
FIG. 1A is an exploded perspective view of a transformer according to a first embodiment of the present invention.
Figure 1B:
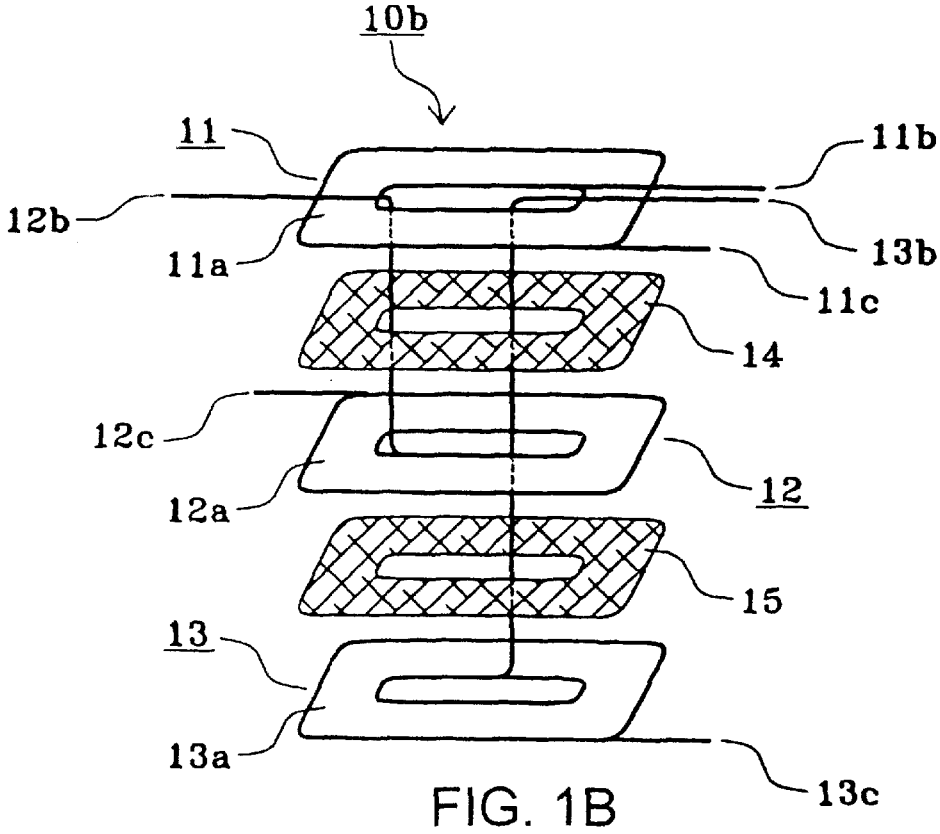
FIG. 1B is an exploded perspective view of a transformer according to a second embodiment of the present invention.
Figure 2A:
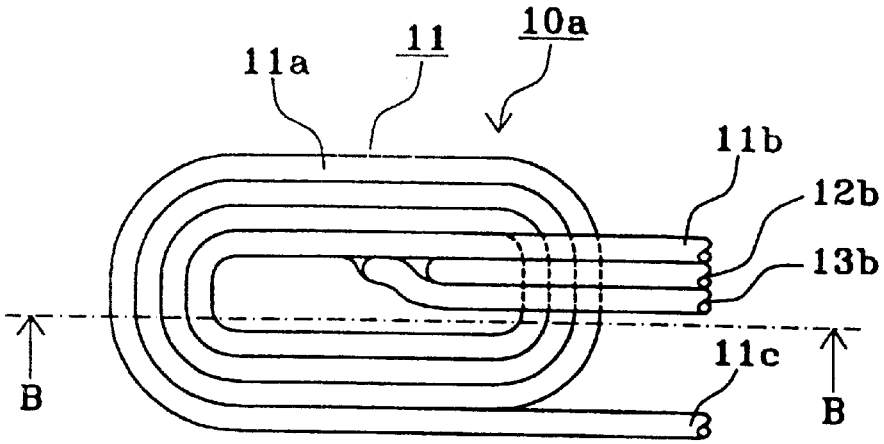
FIG. 2A is a plan view of the transformer shown in FIG. 1A according to the first embodiment of the present invention.
Figure 2B:
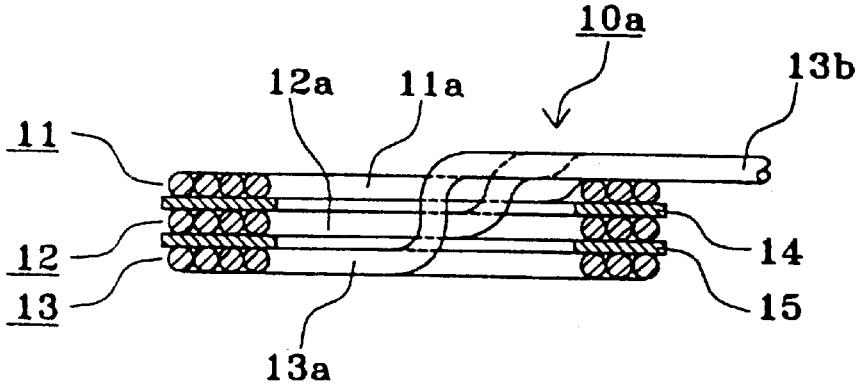
FIG. 2B is a sectional view along line B—B of the transformer shown in FIG. 2A according to the first embodiment of the present invention.
Figure 10:
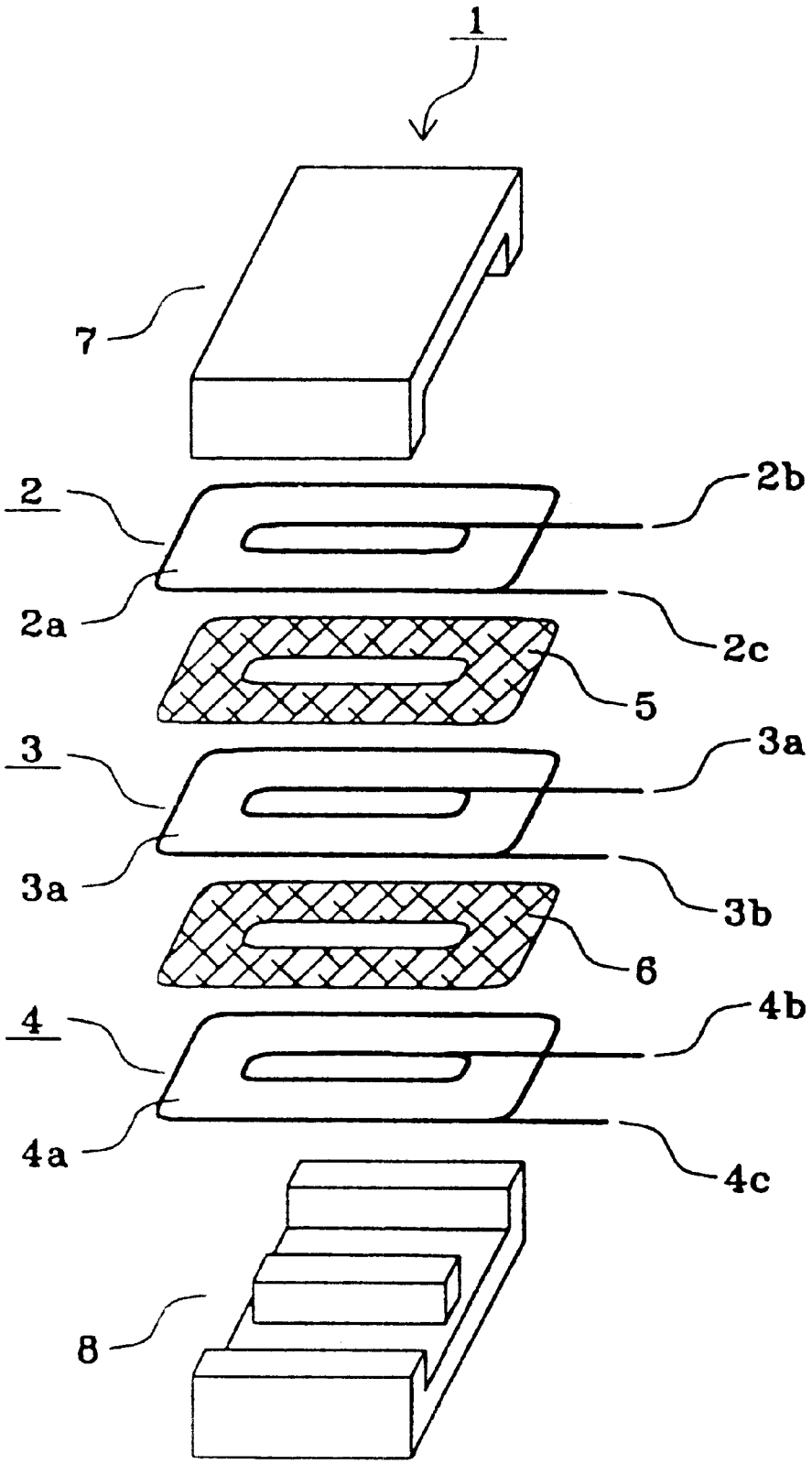
FIG. 10 PRIOR ART
FIG. 10 is an exploded perspective view of a known transformer.
Figure 11A:
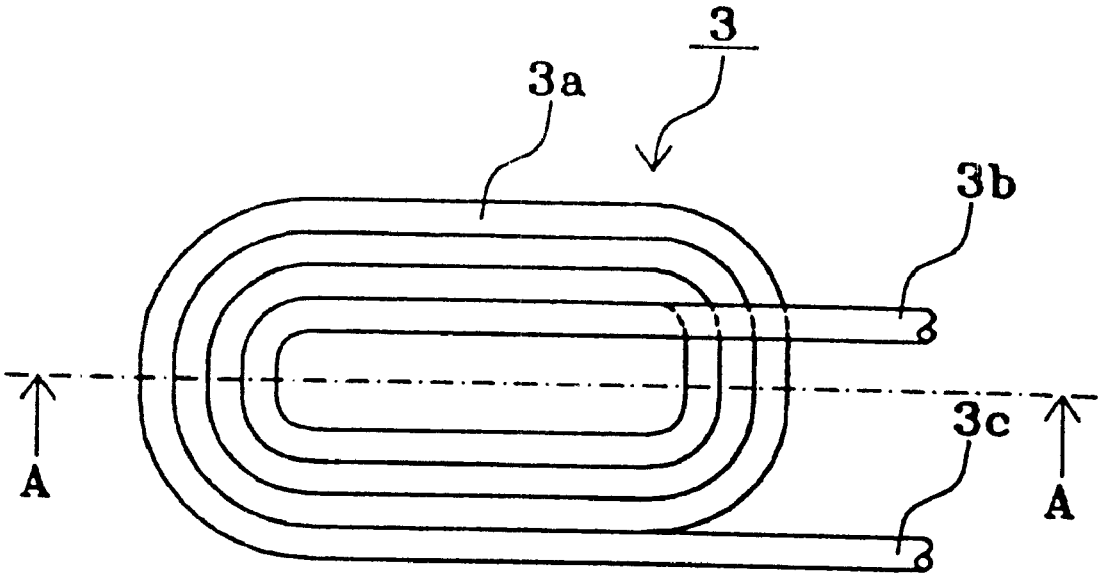
FIG. 11A PRIOR ART
FIG. 11A is a plan view of a flat coil used in the known transformer shown in FIG. 10.
Figure 11B:
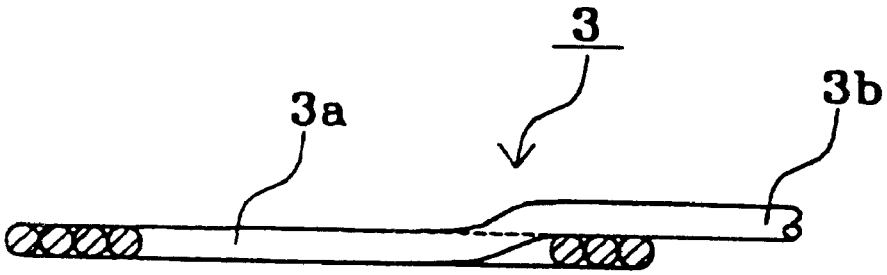
FIG. 11B PRIOR ART
FIG. 11B is a sectional view along line A—A of the flat coil shown in FIG. 11A.

FIG. 1A is an exploded perspective view of a transformer according to a first embodiment of the present invention. FIG. 1B is an exploded perspective view of a transformer according to a second embodiment of the present invention. FIG. 2A is a plan view of the transformer shown in FIG. 1A according to the first embodiment. FIG. 2B is a sectional view along line B—B of the transformer shown in FIG. 2A according to the first embodiment. FIGS. 1A, 1B, 2A, and 2B show major portions of the transformer according to the present invention, in which core members corresponding to the core members 7 and 8 shown in FIG. 10 are omitted so as to avoid complexity in the drawings, the core members being omitted from the drawings referred to in the following description.

In FIGS. 1A, 2A, and 2B, a transformer 10*a* includes flat coils 11, 12, and 13 coaxially stacked with each other, each formed with a wire wound in a spiral. Doughnut-shaped insulative sheets 14 and 15 are disposed between the flat coils 11 and 12 and between the flat coils 12 and 13, respectively. In particular, the flat coils 11, 12, and 13 are formed with wires 11*a*, 12*a*, and 13*a*, respectively. Each of wires 11*a*, 12*a*, and 13*a* is wound in a spiral shape having a through hole at a center thereof such that the wire has an inner end and an outer end at the inner periphery and the outer periphery of the spiral shape, respectively. The flat coils 11, 12, and 13 overlapping each other with the doughnut-shaped insulative sheets 14 and 15 therebetween are provided with holes for passing a magnetic core-leg coaxially formed in a central part of each of the flat coils 11, 12, and 13 and the insulative sheets 14 and 15. The inner end 11*b* of the wire 11*a* forming the flat coil 11 is drawn to the outside of the flat coil 11, that is, the outside of the transformer 10*a* over a wound portion of the wire 11*a*. The inner end 12*b* of the wire 12*a* forming the flat coil 12 is drawn to the outside of the transformer 10*a* through the respective holes for passing a magnetic core-leg of the insulative sheet 14 and the flat coil 11 and over the wound portion of the wire 11*a*. An inner end 13*b* of the wire 13*a* forming the flat coil 13 is drawn to the outside of the transformer 10*a* through the respective holes for passing a magnetic core-leg of the insulative sheet 15, the flat coil 12, the insulative sheet 14, and the flat coil 11 and over the wound portion of the wire 11*a* forming the flat coil 11. That is, the inner ends 11*b*, 12*b*, and 13*b* of the flat coils 11, 12, and 13, respectively, are disposed on the same surface of the flat coil 11. Outer ends 11*c*, 12*c*, and 13*c* of the flat coils 11, 12, 13, respectively, are drawn to the outside of the transformer 10*a* at the same levels as the flat coils 11, 12, and 13, respectively.

In the thus formed transformer 10*a*, the inner ends 11*b*, 12*b*, and 13*b* are drawn to the outside of the transformer 10*a* over the wound portion of the wire 11*a* of the flat coil 11 and are disposed on the same surface of the flat coil 11. Therefore, the thickness of the overall flat coils, which is the sum of the thickness of the three flat coils 11, 12, and 13 and the thickness of a portion of one of the flat coil 11, 12, and 13, of which the inner ends 11*b*, 12*b*, and 13*b*, respectively, are drawn out, is substantially four times the diameter of the wire 11*a*. That is, the transformer 10*a* can be made thinner than the known transformer 1 shown in FIG. 10 by a thickness corresponding to twice the diameter of a wire, whereby the overall transformer 10*a* can be reduced in thickness.

Although in the transformer 10*a* shown in FIGS. 1A, 2A, and 2B, the inner ends 11*b*, 12*b*, and 13*b* of the flat coils 11, 12, and 13, respectively, are brought into contact with each other and into the flat coil 11, it may be necessary to dispose the inner ends 11*b*, 12*b*, and 13*b* separated from each other and to provide an insulative film between the flat coil 11 and the inner ends 11*b*, 12*b*, and 13*b* according to the dielectric strength between the flat coils 11, 12, and 13.

Although in the transformer 10*a* shown in FIG. 1A, the inner ends 11*b*, 12*b*, and 13*b* of the flat coils 11, 12, and 13, respectively, are drawn out over the outer surface (upper side) of the outermost flat coil 11, the inner ends 11*b*, 12*b*, and 13*b* may be drawn out over the outer surface (lower side) of the outermost flat coil 13. The inner ends 11*b*, 12*b*, and 13*b* may be drawn out between the flat coils 11 and 12 or between the flat coils 12 and 13. The inner ends 11*b*, 12*b*, and 13*b* may be drawn out in directions differing from each other, as in a transformer 10*b* according to a second embodiment shown in FIG. 1B, as long as the inner ends 11*b*, 12*b*, and 13*b* are each disposed on the same surface of one of the flat coils 11, 12, and 13. When the inner ends 11*b*, 12*b*, and 13*b* are drawn out between two of the flat coils 11, 12, and 13, an insulative film may be provided between the corresponding flat coil 11, 12, or 13 and the inner ends 11*b*, 12*b*, and 13*b*, as needed.

Figure 3:
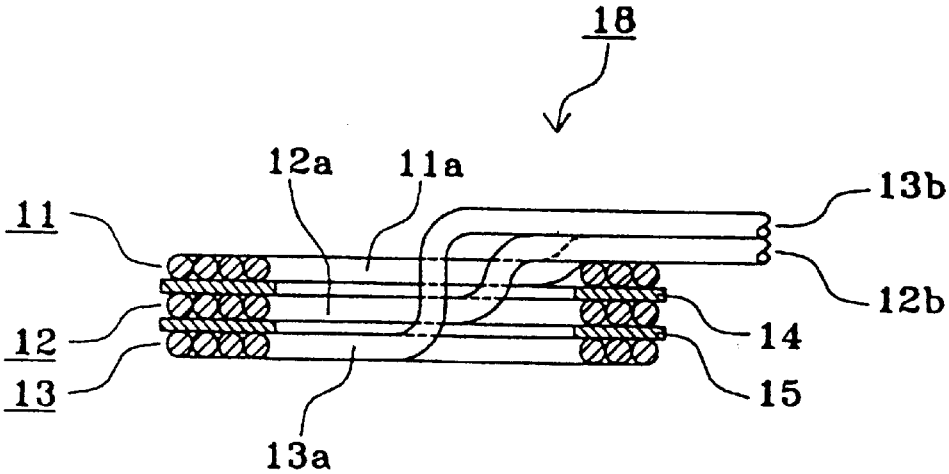
FIG. 3 is a sectional view of a transformer according to a third embodiment of the present invention.

FIG. 3 is a sectional view of a transformer according to a third embodiment of the present invention. The transformer is shown in section along a line corresponding to the line B—B of the transformer 10*a* shown in FIG. 2A. Components the same as or corresponding to those which are shown in FIGS. 2A and 2*b* are referred to with the same reference numerals, for which description is omitted.

In a transformer 18 shown in FIG. 3, the inner end 13*b* of the wire 13*a* forming the flat coil 13 is drawn to the outside of the transformer 18 through the respective holes for passing a magnetic core-leg of the insulative sheet 15, the flat coil 12, the insulative sheet 14, and the flat coil 11 and over the inner ends 11*b* and 12*b* of the flat coils 11 and 12, respectively. That is, the inner ends 11*b* and 12*b* of the flat coils 11 and 12, respectively, are disposed on the same surface of the flat coil 11, and the inner end 13*b* of the flat coil 13 is disposed on the inner ends 11*b* and 12*b*.

In the thus formed transformer 18, the two inner ends 11*b* and 12*b* of the two flat coils 11 and 12, respectively, are drawn to the outside of the transformer 18 over a wound portion of the wire 11*a* of the flat coil 11 on the same surface of the flat coil 11. Therefore, the thickness of the overall flat coils 11, 12, and 13, which is the sum of the thickness of the three flat coils 11, 12, and 13, the thickness corresponding to the diameter of a portion of one of the wires 11*a* and 12*a* of which the inner ends 11*b* and 12*b*, respectively, are drawn out, and the thickness corresponding to the diameter of the inner end 13*b* of the wire 13*a* which is drawn out is substantially five times the diameter of a wire. Although the thickness of the overall flat coils of the transformer 18 is greater than that of the transformer 10*a* or 10*b* shown in FIG. 1A or 1B, respectively, the transformer 18 can be made thinner than the known transformer 1 shown in FIG. 10 by a thickness corresponding to the diameter of the wire 11*a*, 12*a*, or 13*a*, whereby the overall transformer 18 can be reduced in thickness.

The thickness of the transformer 18 can be reduced when the inner ends of at least two flat coils are each drawn out over a surface of one of the flat coils 11, 12, and 13.

Although in the transformer 18 shown in FIG. 3, the inner ends 11*b* and 12*b* of the two flat coils 11 and 12, respectively, are each drawn out over the outer side of the outermost flat coil 11, the two inner ends 11*b* and 12*b* may be drawn out between two flat coils 11 and 12 or 12 and 13, in the same way as in the transformer 10*a* or 10*b* shown in FIG. 1A or 1B, respectively.

Figure 4:
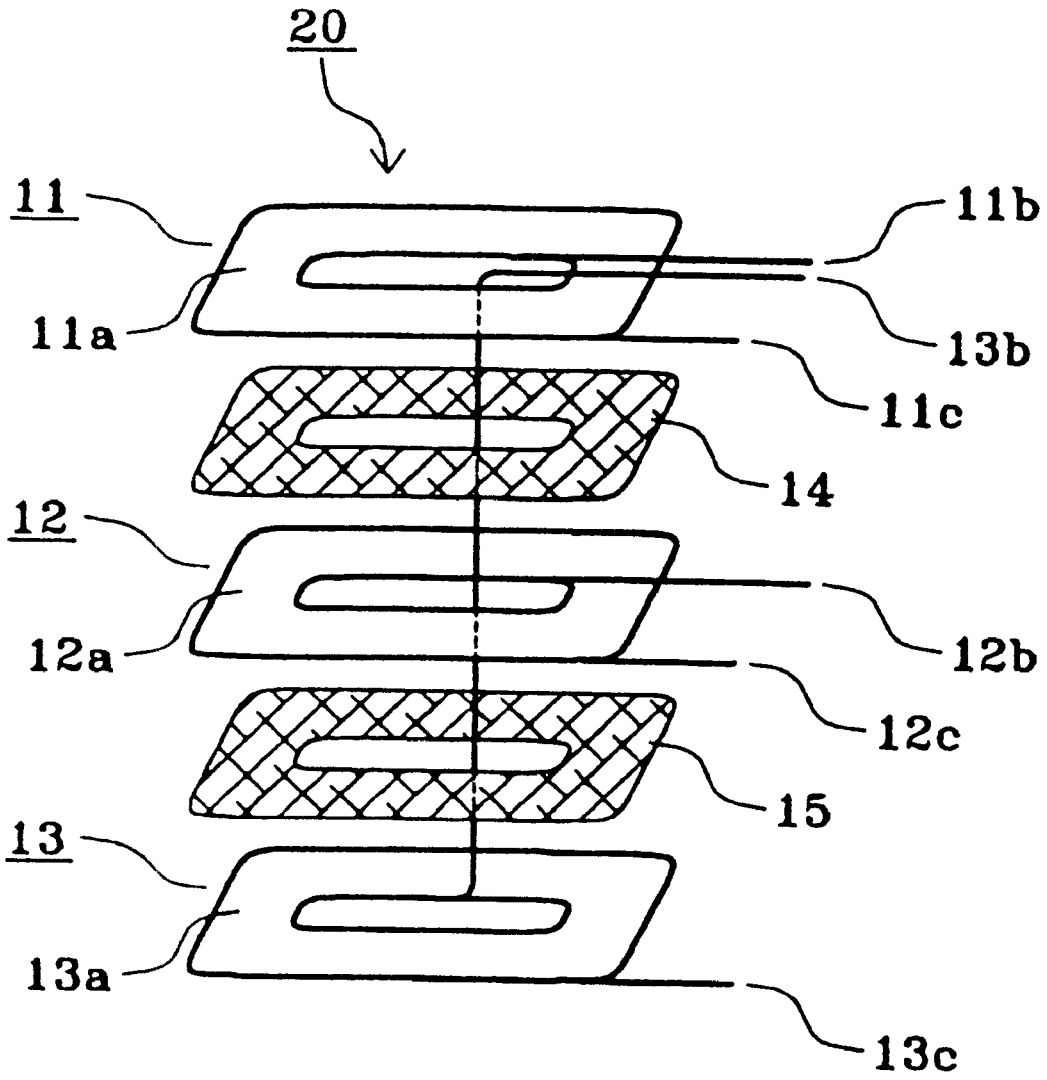
FIG. 4 is an exploded perspective view of a transformer according to a fourth embodiment of the present invention.

FIG. 4 is an exploded perspective view of a transformer according to a fourth embodiment of the present invention, in which components the same as or corresponding to those of the transformers 10*a* and 10*b* shown in FIGS. 1A and 1B, respectively, are referred to with the same reference numerals, for which description is omitted.

In a transformer 20 shown in FIG. 4, the inner ends 1 b and 13*b* of the wire 11*a* and 13*a* forming the flat coils 11 and 13 are drawn to the outside of the transformer 20 over a wound portion of the wire 11*a* forming the flat coil 11, the inner end 13*b* being drawn through the respective holes for passing a magnetic core-leg of the insulative sheet 15, the flat coil 12, the insulative sheet 14, and the flat coil 11. That is, only the inner ends 11*b* and 13*b* of the flat coils 11 and 13, respectively, are disposed on the same surface of the flat coil 11. The inner end 12*b* of the wire 12*a* forming the flat coil 12 is drawn to the outside of the transformer 20 between the flat coils 11 and 12, more particularly, between the insulative sheet 14 and the flat coil 12 over a wound portion of the wire 12*a*.

In the thus formed transformer 20, the two inner ends 11*b* and 13*b* of the two flat coils 11 and 13, respectively, are drawn to the outside of the transformer 20 over the wound portion of the wire 11*a* of the flat coil 11 on the same surface of the flat coil 11. Therefore, the thickness of the overall flat coils, which is the sum of the thickness of the three flat coils 11, 12, and 13, the thickness corresponding to the diameter of one of the inner ends 11*b* and 12*b* of the wires 11*a* and 13*a*, respectively, which are drawn out, and the thickness corresponding to the diameter of the inner end 12*b* of the wire 12*a* which is drawn out is substantially five times the diameter of the wire 11*a*, 12*a*, or 13*a*. Although the thickness of the overall flat coils of the transformer 20 is greater than that of the transformer 10*a* or 10*b* shown in FIG. 1A or 1B, respectively, the transformer 20 can be made thinner than the known transformer 1 shown in FIG. 10 by a thickness corresponding to the diameter of the wire 11*a*, 12*a*, or 13*a*, whereby the thickness of the overall transformer 20 can be reduced.

The transformer 20 can be reduced in thickness when the inner ends of at least two flat coils are each drawn out over a surface of one of the flat coils 11, 12, and 13.

Although in the transformer 20 shown in FIG. 4, the inner ends 11*b* and 13*b* of the two flat coils 11 and 13, respectively, are each drawn out over the outer side of the outermost flat coil 11, the two inner ends 11*b* and 13*b* may be drawn out between two flat coils 11 and 12 or 12 and 13, in the same way as in the transformer 10*a* or 10*b* shown in FIG. 1A or 1B, respectively.

Figure 5:
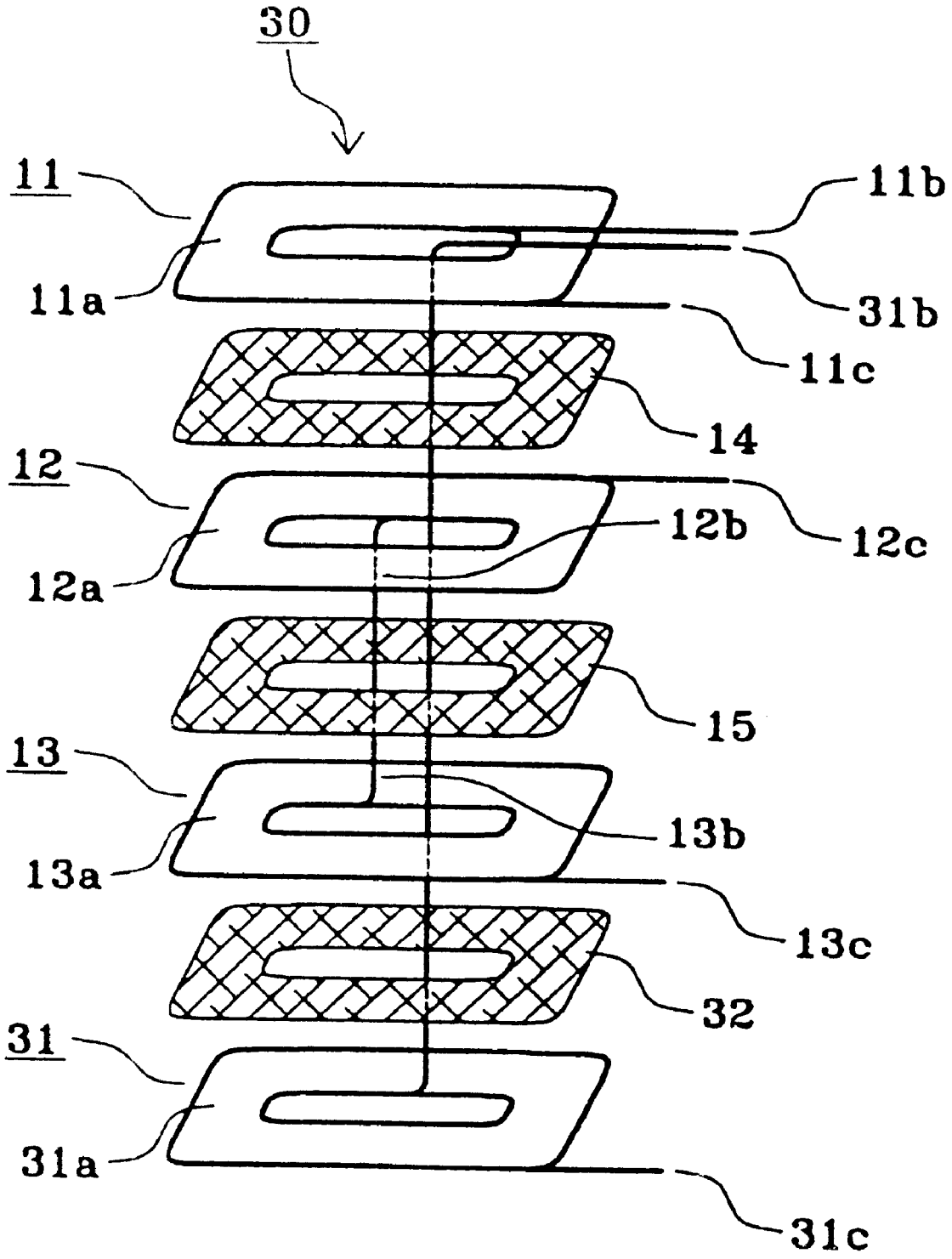
FIG. 5 is an exploded perspective view of a transformer according to a fifth embodiment of the present invention.

FIG. 5 is an exploded perspective view of a transformer according to a fifth embodiment of the present invention, in which components the same as or corresponding to those of the transformers 10*a* and 10*b* shown in FIGS. 1A and 1B, respectively, are referred to with the same reference numerals, for which description is omitted.

A transformer 30 shown in FIG. 5 is provided with a flat coil 31 in addition to the transformer 10*a* or 10*b* shown in FIG. 1A or 1B, respectively, the flat coil 31 being disposed on the outer side of the flat coil 13 with a doughnut-shaped insulative sheet 32 between the flat coils 13 and 31. The flat coil 31 is formed by winding a wire in a spiral. An end 31*b* of a wire 31*a* forming the flat coil 31 is drawn to the outside of the transformer 30 through the holes for passing a magnetic core-leg of the insulative sheet 32, the flat coil 13, the insulative sheet 15, the flat coil 12, the insulative sheet 14, and the flat coil 11 and over a wound portion of the wire 11*a* of the flat coil 11. That is, the inner ends 11*b* and 31*b* of the flat coils 11 and 31, respectively, are each disposed on the same surface of the flat coil 11. The inner end 12*b* of the wire 12*a* forming the flat coil 12 and the inner end 13*b* of the wire 13*a* forming the flat coil 13 are connected to each other in the holes for passing a magnetic core-leg of the flat coils 12 and 13 and the insulative sheet 15. The outer ends 11*c*, 12*c*, 13*c* and 31*c* of the four flat coils 11, 12, 13, and 31, respectively, are drawn to the outside of the transformer 30 at respective levels of the flat coils 11, 12, 13, and 31.

The thus formed transformer 30 can be reduced in thickness by drawing the inner ends 11*b* and 31*b* of the two flat coils 11 and 31, respectively, to the outside of the transformer 30, each inner end 11*b* or 31*b* being disposed on the same surface of the flat coil 11. The inner ends 12*b* and 13*b* of the two flat coils 12 and 13, respectively, are connected to each other, whereby the inner ends 12*b* and 13*b* are not necessarily drawn to the outside of the transformer 30, thereby omitting a process of preparing lead wires, simplifying winding structures, and reducing manufacturing costs of windings.

Figure 6:
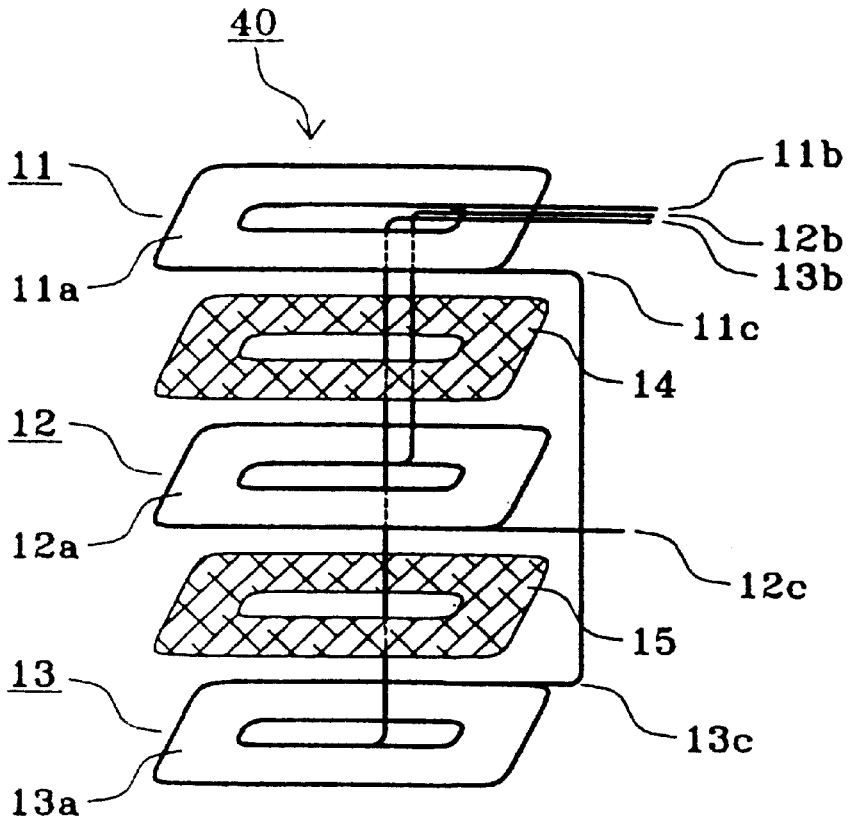
FIG. 6 is an exploded perspective view of a transformer according to a sixth embodiment of the present invention.

FIG. 6 is an exploded perspective view of a transformer according to a sixth embodiment of the present invention, in which components the same as or corresponding to the transformer 10*a* or 10*b* shown. in FIG. 1A or 1B, respectively, are referred to with the same reference numerals, for which description is omitted.

In a transformer 40 shown in FIG. 6, the outer end 11*c* of the flat coil 11 and the outer end 13*c* of the flat coil 13 are connected to each other.

In the thus formed transformer 40, the flat coils 11 and 13 can be continuously wound by connecting the outer ends 11*c* and 13*c* of the flat coils 11 and 13, respectively, to each other, thereby omitting a process of preparing lead wires, simplifying winding structures, and reducing manufacturing costs of windings.

Figure 7:
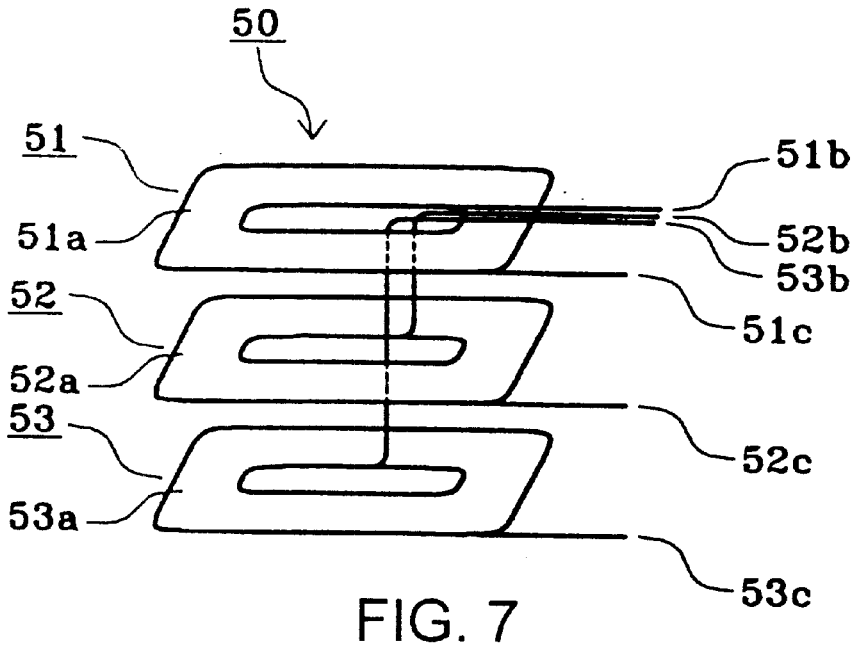
FIG. 7 is an exploded perspective view of a transformer according to a seventh embodiment of the present invention.

FIG. 7 is an exploded perspective view of a transformer according to a seventh embodiment of the present invention. A transformer 50 shown in FIG. 7 includes flat coils 51, 52, and 53 coaxially overlapping each other, each formed by winding a three-layer insulated wires in a spiral. The flat coils 51, 52, and 53 are formed by winding wires 51*a*, 52*a*, and 53*a*, respectively. An inner end 51*b* of the wire 51*a* forming the flat coil 51 is drawn to the outside of the transformer 50 over a wound. portion of the wire 51*a*. An inner end 52*b* of the wire 52*a* forming the flat coil 52 is drawn to the outside of the transformer 50 through a hole for passing a magnetic core-leg of the flat coil 51 and over the wound portion of the wire 51*a* of the flat coil 51. An end 53*b* of the wire 53*a* forming the flat coil 53 is drawn to the outside of the transformer 50 through the respective holes for passing a magnetic core-leg of the flat coils 52 and 51 and over the wound portion of the wire 51*a* of the flat coil 51. The inner ends 51*b*, 52*b*, and 53*b* of the flat coils 51, 52, and 53, respectively, are each disposed on the same surface of the flat coil 51. Outer ends 51*c*, 52*c*, and 53*c* of the three flat coils 51, 52, and 53 are drawn to the outside of the transformer 50 at respective levels of the flat coils 51, 52, and 53. The three-layer insulated wire is a conducting wire coated with three layers of insulating materials differing from each other about the conducting wire, thereby providing a high dielectric strength.

The thus formed transformer 50 differs from the transformers 10*a* and 10*b* shown in FIGS. 1A and 1B, respectively, in that the transformer 50 is not provided with insulative sheets between the flat coils 51 and 52 and between the flat coils 52 and 53. This is because the dielectric strength between the flat coils 51, 52, and 53 becomes large by virtue of the three-layer insulated wires 51*a*, 52*a*, and 53*a*, whereby the insulative sheets 14 and 15 can be eliminated.

Since the insulative sheets 14 and 15 can be eliminated by using the three-layer insulated wires 51*a*, 52*a*, and 53*a*, the thickness of the transformer 50 can be reduced further.

Figure 8:
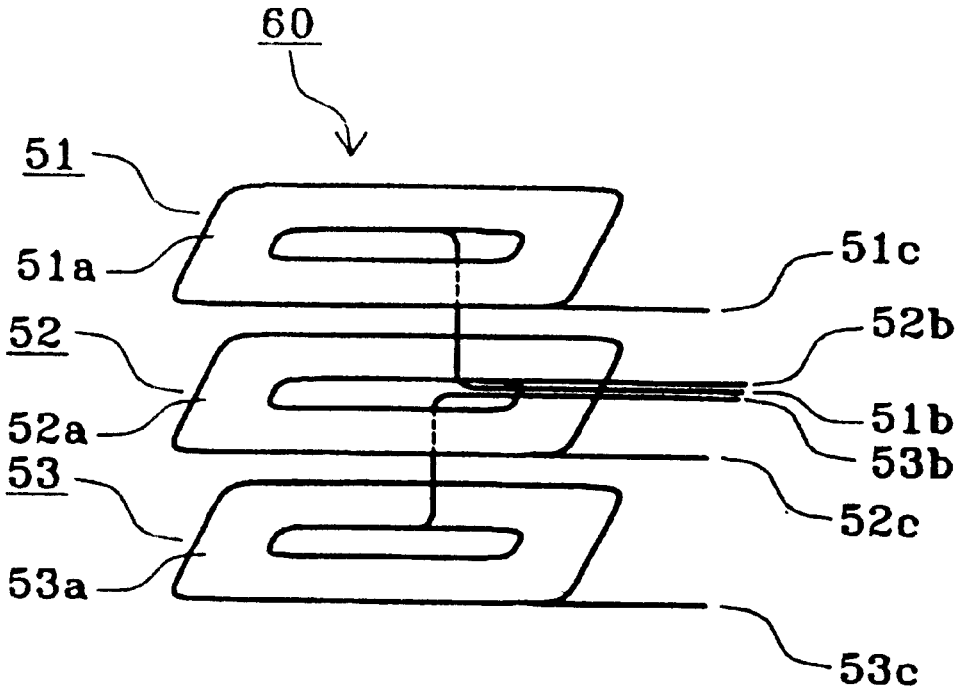
FIG. 8 is an exploded perspective view of a transformer according to an eighth embodiment of the present invention.

FIG. 8 is an exploded perspective view of a transformer according to an eighth embodiment of the present invention, in which components the same as or corresponding to those of the transformer 50 shown in FIG. 7 are referred to with the same reference numerals, for which description is omitted.

In a transformer 60 shown in FIG. 8, the inner end 51*b* of the wire 51*a* forming the flat coil 51 is drawn to the outside of the transformer 60 between the flat coils 51 and 52 and over a wound portion of the wire 52*a* of the flat coil 52. The inner end of the wire 52*a* forming the flat coil 52 is drawn to the outside of the transformer 60 over the wound portion of the wire 52*a*. The inner end 53*b* of the wire 53*a* forming the flat coil 53 is drawn to the outside of the transformer 60 through the hole for passing a magnetic core-leg of the flat coil 52 and over the wound portion of the wire 52*a* of the flat coil 52. That is, the inner ends 51*b*, 52*b*, and 53*b* of the flat coils 51, 52, and 53, respectively, are disposed between the flat coils 51 and 52 and on the same surface of the flat coil 52.

In the thus formed transformer 60 in which the inner ends 51*b*, 52*b*, and 53*b* of the three flat coils 51, 52, and 53, respectively, are drawn out between the flat coils 51 and 52, insulative sheets, for ensuring the dielectric strength between the flat coil 51 and the inner ends 51*b*, 52*b*, and 53*b* and between the inner ends 51*b*, 52*b*, and 53*b* and the flat coil 52, are not provided because a sufficient dielectric strength is maintained by using the three-layer insulated wires 51*a*, 52*a*, and 53*a*. Therefore, the thickness of the transformer 60 can be reduced further.

Figure 9:
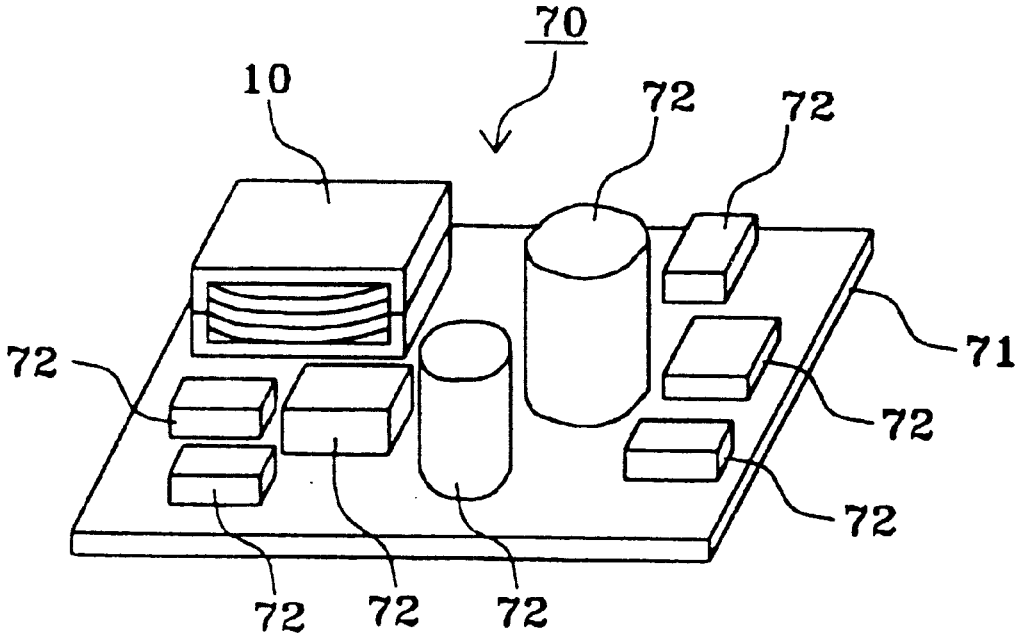
FIG. 9 is a perspective view of an electrical apparatus according to a ninth embodiment of the present invention.

FIG. 9 is a perspective view of an electrical apparatus according to a ninth embodiment of the present invention, in which an electrical device 70 is a switching power supply device which uses the transformer 10*a* according to the present invention. The electrical device 70 includes a substrate 71 mounted with the transformer 10*a* according to the present invention, resistors, capacitors, choke coils, etc., and semiconductors such as transistors, diodes, and integrated circuits, these components being connected to each other via wires formed on the substrate 71.

The thus formed electrical device 70 can be reduced in thickness and in size by reducing the thickness of the transformer 10*a*.

Although the switching power supply device is shown in FIG. 9 as an electrical device, the present invention may be applied to other electrical devices, such as analogue circuits and speaker devices, which use transformers according to the present invention.

What is claimed is:

1. A transformer comprising:

first and second flat coils being stacked with each other, each of the first and second flat coils comprising a conductive wire which is wound in a flat spiral shape having a through hole at a center thereof such that the conductive wire has an inner end and an outer end at an inner periphery and an outer periphery of the spiral shape, respectively, wherein the inner end of the first flat coil passes through the through hole of the second flat coil.

2. The transformer of claim 1, further comprising third and fourth flat coils each comprising a conductive wire which is wound in a flat spiral shape having a through hole at a center thereof such that the conductive wire has an inner end and an outer end at an inner periphery and an outer periphery of the spiral shape, respectively, wherein the inner end of the third and fourth flat coils are connected with each other.

3. The transformer of claim 1, further comprising third and fourth flat coils each comprising a conductive wire which is wound in a flat spiral shape having a through hole at a center thereof such that the conductive wire has an inner end and an outer end at an inner periphery and an outer periphery of the spiral shape, respectively, wherein the outer end of the third and fourth flat coils are connected with each other.

4. The transformer of claim 1, wherein the wire forming at least one of the first and second flat coils is an insulated wire.

5. The transformer of claim 4, wherein the wire forming at least one of the first and second flat coils is a three layer insulated wire.

6. The transformer of claim 5, wherein said wire is a self-welding-type three-layer insulated wire.

7. The transformer of claim 1, further comprising an insulating sheet having a through hole and being provided between the first and second flat coils, the inner end of the first flat coil passing through the through hole of the insulating layer.

8. The transformer of claim 1, further comprising a core, at least a portion of the core passing through the through holes of the first and second flat coils.

9. The transformer of claim 1, further comprising a third flat coil stacked with the first and second flat coils and comprising a conductive wire wound in a flat spiral shape and having a through hole at a center thereof such that the conductive wire has a an inner and an outer end at an inner periphery and an outer periphery of the spiral shape, respectively, wherein the inner end of the third coil passes through the through hole of at least one of the first and second flat coils.

10. The transformer of claim 9, wherein the inner end of the third coil passes through the through hole of both the first and second flat coils.

11. An electrical device comprising a transformer and a circuit coupled to the transformer, the transformer comprising:

first and second flat coils being stacked with each other, each of the first and second flat coils comprising a conductive wire which is wound in a flat spiral shape having a through hole at a center thereof such that the conductive wire has an inner end and an outer end at an inner periphery and an outer periphery of the spiral shape, respectively, wherein the inner end of the first flat coil passes through the through hole of the second flat coil.

12. The electrical device of claim 11, further comprising third and fourth flat coils each comprising a conductive wire which is wound in a flat spiral shape having a through hole at a center thereof such that the conductive wire has an inner end and an outer end at an inner periphery and an outer periphery of the spiral shape, respectively, wherein the inner end of the third and fourth flat coils are connected with each other.

13. The electrical device of claim 11, further comprising third and fourth flat coils each comprising a conductive wire which is wound in a flat spiral shape having a through hole at a center thereof such that the conductive wire has an inner end and an outer end at an inner periphery and an outer periphery of the spiral shape, respectively, wherein the outer end of the third and fourth flat coils are connected with each other.

14. The electrical device of claim 11, further wherein the wire forming at least one of the first and second flat coils is an insulated wire.

15. The electrical device of claim 14, further wherein the wire forming at least one of the first and second flat coils is a three layer insulated wire.

16. The electrical device of claim 15, further wherein said wire is a self-welding-type three-layer insulated wire.

17. The electrical device of claim 11, further comprising an insulating sheet having a through hole and being provided between the first and second flat coils, the inner end of the first flat coil passing through the through hole of the insulating layer.

18. The electrical device of claim 11, further comprising a core, at least a portion of the core passing through the through holes of the first and second flat coils.

19. The electrical device of claim 11, further comprising a third flat coil stacked with the first and second flat coils and comprising a conductive wire wound in a flat spiral shape and having a through hole at a center thereof such that the conductive wire has an inner end and an outer end at an inner periphery and an outer periphery of the spiral shape, respectively, wherein the inner end of the third coil passes through the through hole of at least one of the first and second flat coils.

20. The electrical device of claim 11, further wherein the inner end of the third coil passes through the through hole of both the first and second flat coils.

* * * * *